United States Patent [19]

Logsdon

[11] Patent Number: 4,719,452

[45] Date of Patent: Jan. 12, 1988

[54] AUDIO SIGNAL GENERATOR

[75] Inventor: William K. Logsdon, Louisville, Ky.

[73] Assignee: Bluegrass Electronic, LaGrange, Ky.

[21] Appl. No.: 622,661

[22] Filed: Jun. 20, 1984

[51] Int. Cl.[4] ..... G08B 3/00

[52] U.S. Cl. ..... 340/384 E

[58] Field of Search ..... 340/384 E, 384 R; 331/47, 52

[56] References Cited

U.S. PATENT DOCUMENTS

| | | | |
|---|---|---|---|
| 3,483,479 | 11/1969 | Harshbarger | 331/52 |
| 3,609,579 | 9/1971 | Chappell et al. | 331/52 |
| 4,104,628 | 8/1978 | Sweany et al. | 340/384 E |
| 4,186,387 | 1/1980 | Moschgat | 340/384 E |
| 4,293,851 | 10/1981 | Beyl, Jr. | 340/384 E |

*Primary Examiner*—John W. Caldwell, Sr.
*Assistant Examiner*—Tyrone Queen
*Attorney, Agent, or Firm*—Edward M. Steutermann

[57] ABSTRACT

Audio frequency signal generator to generate signals in a selected band of audio frequencies to generate a noise having an amplitude pattern which simulates the noise generated by a selected occurrence which can be utilized for setting the actuation range of an audio actuated alarm device which is capable of discriminating the noise generated by such an occurrence where the generated frequency of the sound and amplitude of the sound waves can be varied selectively to simulate the pattern of the sound waves emanating from the selected occurrence.

3 Claims, 3 Drawing Figures

AUDIO SIGNAL GENERATOR

BACKGROUND OF THE INVENTION

The present invention relates to devices useful in testing and adjusting audio sound detecting devices such as burglar alarms or intrusion detectors which are actuated by the sound waves of a particular occurrence and are unaffected by other sounds.

Typically, audio detecting devices are utilized in burglar alarms and intrusion detection devices to detect, audible indications of intrusion, inter alia, breaking glass.

In the prior art the installation of the device and setting the operating parameters for operation of the installed device has been a problem. More particularly the setting of the sensitivity and frequency band of the device has generally been accomplished by trial and error methods. For example, in one method particles of glass are shaken in a container to simulate the sound generated by breaking glass to set the detection limits of the device. In another, and better but more troublesome method, glass is actually broken in the vicinity of the detector to set the limits of operation.

The latter methods have obvious disadvantages and are in fact, of little practical usefulness since it has been found that setting the limits of a sound discriminating detector by utilizing facilities other than sound patterns simulating the actual occurrences prevents full utilization of the capabilities of the sound discriminating device. Further, intrusion into a given location can generate sound frequencies which vary with the method used to accomplish the intrusion.

In a co-pending application Ser. No. 376,170, Durand, now U.S. Pat. No. 4,552,022, one device for selecting the sensitivity of a sound discriminating alarm is disclosed to generate sound of the intrusion in order to fully calibrate audio actuated devices. Additionally, co-pending application Ser. No. 381,955, Durand, now abandoned, describes a method and apparatus for generating simulated audio frequencies.

No other prior art method is known to artifically simulate the audio frequencies and the time change of the amplitude thereof which would normally occur during an intrusion.

SUMMARY OF THE INVENTION

The present invention recognizes that in some occasions, for example breaking glass, the sound generated is of random frequency with a somewhat characteristic amplitude pattern. Accordingly, the present invention provides a straight forward, economical audio signal generating device to effectively generate sound with a range of audio frequencies and the amplitudes thereof which would normally be encountered by an intrusion into a specific area, for example the characteristics of breaking glass.

Devices within the scope of the present invention are inexpensive, compact and portable. Further, such devices can easily be utilized by technicians making an installion of an audio frequency actuated intrusion alarm without the necessity of actually breaking glass. Further, devices within the scope of the present invention can easily be transported form one location to another.

Devices within the scope of the present invention can also provide internal power source control means which provide means to indicate a selected power supply low voltage and to disable the device at lower selected voltage levels which can be effectively incorporated into the device to avoid erroneous settings.

More particularly, devices within the scope of the present invention provide an audio burst of mixed frequency that starts at a selected amplitude and sweeps to lower amplitude at a controlled rate to approximate the initial amplitude and the following amplitudes of the sound waves generated by breaking glass during a single tone burst.

Devices within the scope of the present invention have been effectively utilized to adjust sensitivity and calibration of audio signal detecting devices for use as intrusion alarm or burglar alarms and have been found to operate satisfactorily for a wide range of applications.

While various arrangements within the scope of the present invention will occur to those skilled in the art upon reading the disclosure set forth hereinafter, one example in accordance with the present invention is as shown in the accompanying figures.

DETAILED DESCRIPTION OF THE DRAWINGS

Figure 1:
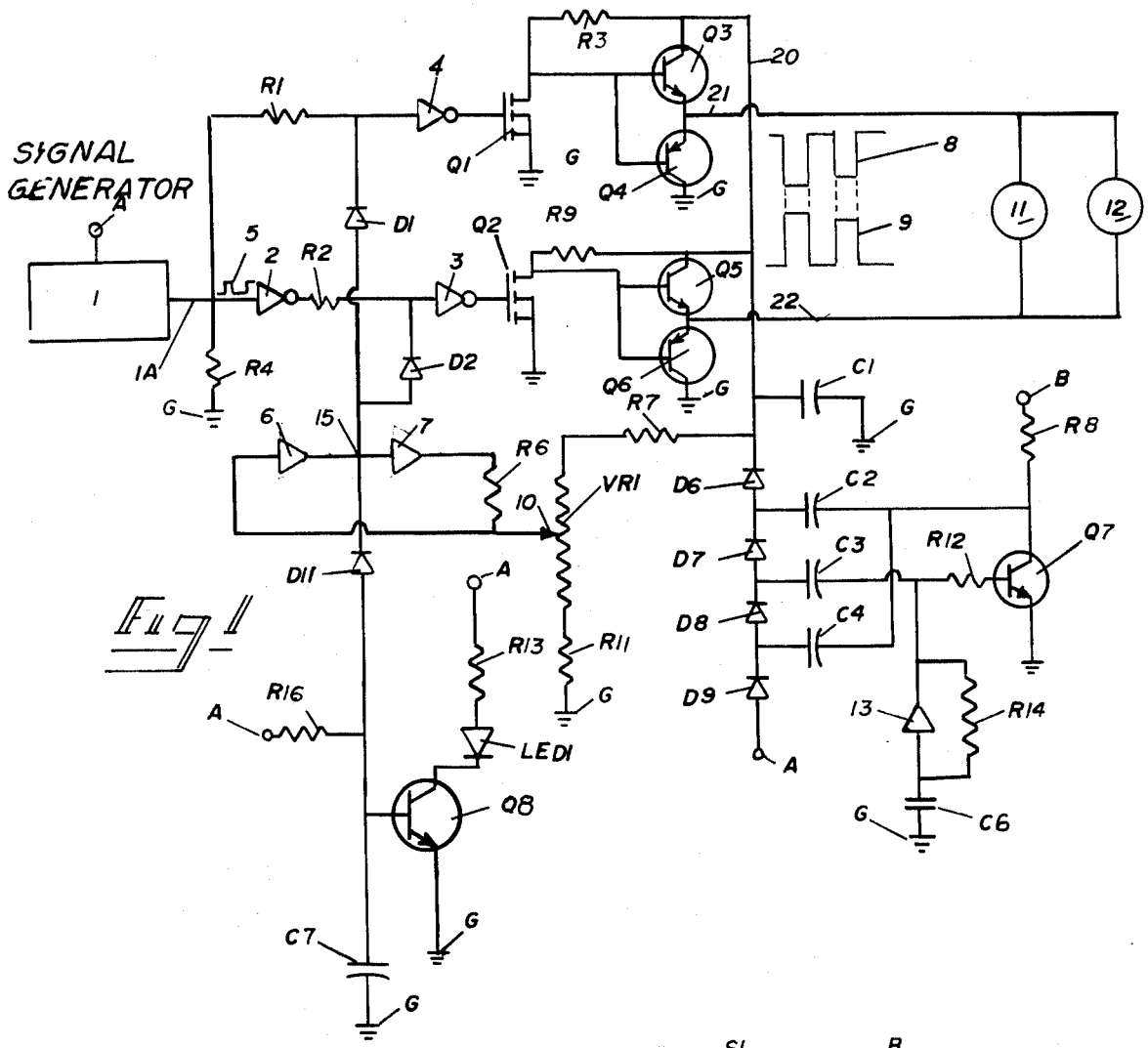
FIG. 1 is a schematic illustration of a device within the scope of the present invention.

In the arrangement shown in FIG. 1 a device is provided to supply a audio signal which simulates the breaking of glass.

In FIG. 1, a pseudo random signal generator 1, for example part No. S2688 American Micro Systems Inc., is provided to be supplied from a power source A, for example, plus 8 volts to produce a generally square waveform signal 5 at output 1A with content similar to "white noise". The signal produced provides frequencies outside the range of frequencies of breaking glass but supplies a sufficient content within the range of breaking glass, generally 3 to 20 Kh. Signal 5 from generator 1 is supplied first to an inverter 2 then through a resistor R2 to a second inverter 3. The signal is also supplied in parallel to a third inverter 4 through a resistor R1. Inverters 3 and 4 act as buffers to drive transistors Q1 and Q2 with signals which are out of phase because the signal supplied to transistor Q2 has been twice inverted. Signals from inverters 3 and 4 gate transistors Q1 and Q2. While other configurations can be used it has been found that transistors Q1 and Q2 are preferably field effect transistors because they provide full "off" and full "on" operation to eliminate delay of the output of the signals and further eliminate the effects of "stored charge delay" commonly encountered in circuits using bipolar transistors. The transistors Q1 and Q2 serve as voltage amplifiers to drive the following stages. The drains of transistors Q1 and Q2 are connected to the bases of PNP transistors Q3 and Q5 and to NPN transistors Q4 and Q6 respectively, as shown, and to parallel resistors R3 and R4 are provided in parallel to the collectors of transistors Q3 and Q5 to act as drain pullup loads to facilitate their function as voltage amplifiers. The transistor pairs Q3, Q4 and Q5, Q6 serve as current amplifiers to drive the speakers described hereinafter. Outputs 21, 22 are provided between the transistors Q3, Q4 and Q5, Q6 respectively and connected to speakers 11, 12 which, camn be piezo ceramic speakers which have been found to be more effective in the application described herein than dynamic tweeters or other type speakers. However such speakers and others, can be utilized within the scope of the present invention. Wave forms 8 and 9 illustrate the character of the signals provided by outputs 21 and 22 respectively showing that the signals provided are out of phase and provide the drive means for the speakers 11, 12.

The collectors of transistors Q3, Q5 are also connected to a voltage multiplier circuit supplied from voltage sources A and B described hereinafter. Source B, for example, +12 volts is connected through a resistor R8 to the collector of a transistor Q7 having its base connected to a cathode of capacitor C3 and to the output of an inverter 13, with parallel resistor R14 and in series with a capacitor C6 to ground. Transistor Q7 is gated from the output of Schmitt trigger stage 13 which in combination with resistors R14 and capacitor C6 comprise an oscillator while transistor Q7 in conjuction with resistor R12 and R8 comprise an inverter/voltage amplifier stage. The output from Schmitt trigger 13 drives capacitor C3 and the inverted amplified output from the collector of transistor Q7 drives the capacitors C2 and C4. Accordingly alternating drive is supplied to the junction between diode pair D6–D7 and D8–D9. The result of this action is to step the original voltage A up at each diode junction node by an amount proportioned to the switching signal amplitude at the driven sides of the capacitors C2–C4. By proper selection of voltage sources and component values the voltage appearing across capacitor C1 can be attained to operate the system and specifically to generate sufficient voltage to operate speakers 11 and 12. In operation the voltage multiplier supplies, for example in the present embodiment +33 volts when transistors Q4 and Q6 are nonconductive. Thus when one of the transistor Q3, Q5 goes nonconductive, Q4, Q6 goes conductive, alternately, providing an alternating voltage signal derived from signal source 1, to speakers 11, 12, the level of said alternating voltage being dependent upon the voltage on capacitor C1 at any given moment, and decreasing in level with respect to time as long as the transistors Q3, Q4, Q5, Q6 are switched.

Capacitor C1 is provided to the collector line to the transistors Q3 and Q5 to act as a charge reservoir for driving the speakers and to switch Schmitt triggers 6 and 7 as described hereinafter.

A voltage divider circuit is provided by a circuit including resistor R7 connected to collector line 20 through a variable resistor VR1 to ground through resistor R11 where the voltage at wiper 10 can be selectively adjusted to set the threshold point of triggers 6 and 7. Wiper 10 is connected to a Schmitt trigger pair 6, 7 where the signal at common point 15 intermediate the triggers 6, 7 is supplied through diodes D1, D2 to the inverting buffers 3 and 4 to transistors Q1, Q2 to disable the inverters 3, 4 during periods between sound bursts from speakers 11, 12 while capacitor C1 is recharging. In this context Schmitt trigger pairs 6, 7 acts as a timer at a rate depending on the setting of wiper arm 10 and the charge rate of capacitor C1 and the characteristics particularly the sourcing impedance of the voltage multiplier. Variable resistor V R1 allows calibration of the level of sound generated by determining the maximum voltage to which capacitor C1 is charged. A light emitting diode LED 1 is provided to the emitter of a transistor Q8 from voltage source A, for example 8 volts, through a resistor R13. Transistor Q8 is gated by voltage supply A through resistor R16 in series with diode D11 to the common point 15 and is grounded through a capacitor C7.

In operation the signal generated by signal generator 1 is supplied first to inverter 2 and inverted so that out of phase signals are supplied to inverters 3 and 4. These signals alternately gate the transistors Q1, Q2 to supply the gating signal to transistors Q3, Q4 and Q5, Q6. For example, with respect to transistors Q3, Q4 with a "Lo" on inverter 4 so the output is "Hi" transistor Q1 is gated to ground so transistor Q3 would normally be nonconductive and PNP transistor Q4 would normally be conductive so transistor Q4 would drain current from speakers 11 and 12. When a "Hi" arrives at inverter 4 transistor Q1 goes nonconductive so that transistor Q3 is gated-on, transistor Q4 goes nonconductive and voltage is applied to speaker 11 and 12.

Figure 3:
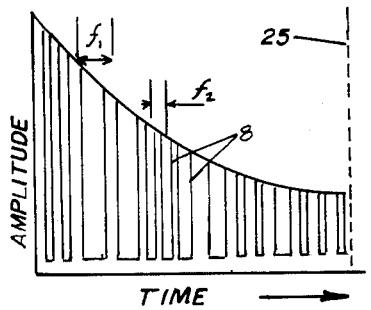
FIG. 3 is a graphic illustration of the signal from a device within the scope of the present invention.

Inverter 3 (and 4) are operated by the combination of the signals generated by generator 1 and the signal from Schmitt triggers. The generator 1 supplies the waveform and the triggers 6 and 7 supply the actuation, as described hereinafter. Within the scope of the present invention the signals are supplied to inverters 3 and 4 in bursts. As known in the art the Schmitt triggers 6 and 7 possess a threshold voltage which is proportional to the supply voltage, in this case +5.6 Vdc for switching. Wiper arm 10 is set so that with +33 plus voltage at line 20 the trigger 6 switches to provide "Lo" on the output. In the example shown, Schmitt triggers 6 and 7 are provided in series with resistor R6 which provides positive feedback which has the effect of enhancing the hysteresis of the combination by altering the threshold to, in this case 33 volts at which point trigger 6 switches "Lo". When trigger 6 switches the threshold is lowered to, for example 15 Vdc. Before this occurs, however, the output of trigger 6 is "Hi", thus blocking the output from generator 1, and holding the outputs of both inverters 3 and 4 "Lo". This occurs when the voltage multiplier circuit previously described is charging capacitor C1. When capacitor C1 has reached a voltage, for example +33 Vdc, plus the threshold voltage of trigger 6 is reached, the output of trigger 6 goes "Lo", the threshold of trigger combination 6 and 7 is lowered, capacitor C7 is discharged, and the signal from generator 1 reaches the inverters 3 and 4. At this time capacitor C1 begins to discharge so the voltage applied to speakers 11 and 12 decay to provide diminishing amplitude sounds of variable frequency F1 and F2 (depending upon the frequencies generated by generator 1), as shown in FIG. 3. When the voltage on capacitor C1 has decayed to such level as to reach the lower threshold of trigger 6, the output of trigger 6 goes "Hi", once again blocking output from generator 1, raising the threshold of trigger 6, and allowing capacitors 1 and 7 to begin a new charge cycle. Thus the duration of the sound burst emitted from speakers 11 and 12 are determined by both the discharge rate of capacitor C1, and the hysteresis of trigger combination 6, 7.

It will be recognized that because of inverter 2 the opposite happens on line 22 from inverter 3, transistor Q2 and transistor Q5 so that the speakers 11 and 12 are alternately actuated because when inverter 4 sees a "Lo" inverter 3 sees a "Hi". The amplitude of the curve shown in FIG. 3 can be adjusted by adjustment of wiper arm 10 of VR1.

A battery condition indicator is provided by the light emitting diode LED 1 which is supplied from a voltage source A, for example plus 8 volts, to the collector of darlington transistor Q8.

Since the rate of charging of capacitor C1 depends upon the value of voltage source B, the interval between sound bursts is thus determined. Also, the frequency of discharge of capacitor C7 is determined, for the same reason. As long as the voltage on capacitor C7 is below the base-emitter drop of Q8, Q8 is cut off, and the LED stays off. Should the interval between sound bursts become longer as a result of voltage source B becoming lower, C7 may not be discharged in time, allowing the voltage on C7 to reach Q8's threshold, and the LED would then light until C7 is discharged again so the LED 1 flashes if voltage B diminishes. Further should the power source diminish to the point that a sufficient voltage cannot be developed on capacitor C1, trigger 6 and 7 will never change state, the output of generator 1 remains blocked, and the LED comes on and stays on.

Figure 2:
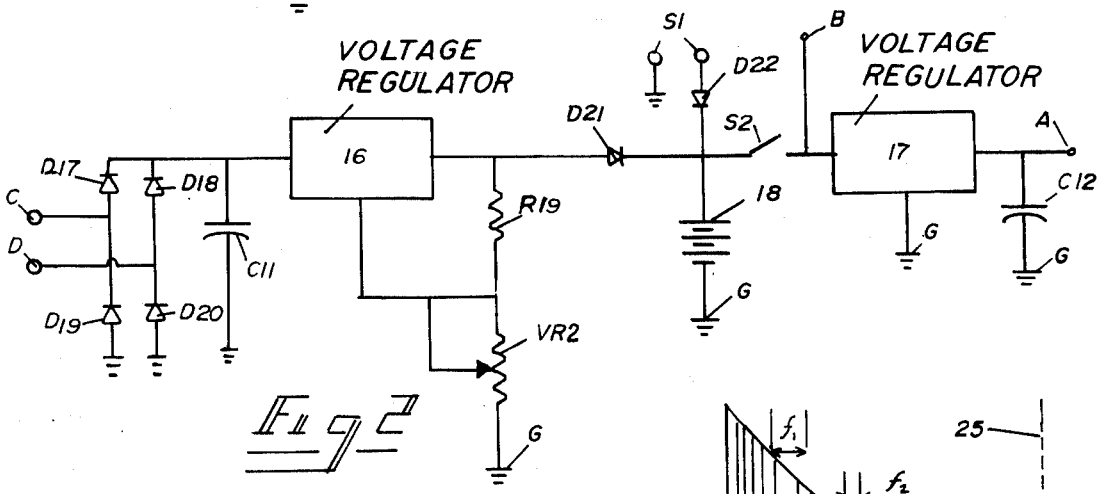
FIG. 2 is a schematic illustration of a power supply arrangement useful in the device shown in FIG. 1.

The circuit which furnishes voltage sources A and B is illustrated in FIG. 2 where the unit is connected to the secondary C, D of a transformer and supplied through a rectifier circuit including diodes D11, D13 and D13, D14 in parallel with a filter capacitor C11 to a voltage regulator 16. Voltage regulator 16 can be supplied with an adjusting circuit including a variable resistor VR2 to ground and a resistor R16 as known in the art. The output from the voltage regulator 16 is supplied through a diode D21 to a battery 18 and through a switch S2 to a second voltage regulator 17. The B voltage is supplied as shown and the A voltage source is supplied form the voltage regulator 17. An external DC input terminal S1 can also be provided.

The invention claimed is:

1. An audio frequency generator to generate signals in a selected band of frequencies including:

(a) signal generator means to generate first cyclical signals of selected frequency having a first output to supply said first cyclical signals;

(b) electrical power source means;

(c) first switch means having first switch actuation means input to receive said first signals, power input means to receive electrical power from said power source means and a power output wherein said first switch means is operated between first state and second state, in response to signals received at said first switch actuation input means, to supply electrical power at said power output when said first switch is in said first state whereby power is cycled at a rate determined by the frequency of said first signal wherein said first switch means includes:

(i) first transistor means to receive said first cyclical signals at the actuating input thereof and having said power source connected to an input thereof and an output connected to ground means so said first transistor is switched between first state wherein said first switch is in conductive status and said second state where said first switch is in nonconductive status by said first cyclical signals to provide a second cyclical signal at said input proportional to said first cyclical signal;

(ii) second and third transistor means in series with each other where the actuation means of said second transistor means and said third transistor means are connected to said input to said first transistor means to be actuated by said second cyclical signal as said first transistor switches between conductive and nonconductive states in response to said first cyclical signal wherein said second transistor means is actuated to conductive state by a relatively positive portion of each of said second cyclical signal and third transistor means is actuated to conductive state by the relatively negative portion of said second cyclical signal and where the collector of said second transistor is connected to said power supply means, the emitter of said second transistor is connected to the collector of said third transistor and the emitter of said third transistor is connected to ground means and where said speaker means is connected to said collector of said second transistor whereby power is supplied to said speaker means when said second transistor means is conductive and said third transistor means is nonconductive.

(d) speaker means adapted to be actuated by said power output whereby said speaker provides audio signals of selected amplitude at frequencies generally corresponding to the frequency of said first signals;

(e) where said power source includes a source of electrical current and capacitor means to be charged when said first switch means is in said first state and discharged through said speaker means when said first switch is in said second state whereby the amplitude of said audio signals is proportional to the voltage imposed on said capacitor so the amplitude of said audio signal decreases as the voltage of said capacitor diminishes;

(f) second switch operable between first state in response to first voltage at said capacitor means and second state in response to second voltage at said capacitor means where said second voltage is higher than said first voltage and wherein said second switch means prevents transmission of signals generated by operation of said first switch to said speaker means when said second switch is in said first state and allows transmission of signals generated by said first cyclical signals to said speaker means when said second switch means is in said second state whereby audio signals of variable frequency are provided from said speaker means at amplitudes depending on the voltage at said capacitor means for a period of time equal to the time required for the voltage at said capacitor to decrease from said second voltage to said first voltage.

2. The invention of claim 1 including:

(a) inverter means connected to said first output of invert said first cyclical signal to provide an inverted first cyclical signal;

(b) third switch means having a third switch signal input to receive said inverter first cyclical signal and third switch power input means to recive electrical power from said power source means and a power output connected to ground where said input means is operated between first and second states in response to signals received at said third switch signal input to supply electrical power at said power input at a rate generally equal to the frequency of said first inverted signal so said first switch is in said first state when said second switch is in said second state wherein said speaker means are also actuated by said power output at the frequency of said inverted first signals to provide audio signals of selected amplitude at frequencies generally corresponding to the frequency of said inverted first signals.

3. The invention of claim 1 wherein said second switch means includes:

(i) fourth transistor means to receive said inverted first cyclical signals at the actuating input thereof and having said power source connected to an input thereof and an output connected to ground means so that said first transistor is switched between conductive states, and noncondictive states by said inverted first cyclical signals to provide third cyclical signal at said input proportional to said inverted first cyclical signal;

(ii) fifth and sixth transistor means in series where the actuating means of said fifth transistor means and said sixth transistor means are connected to said input to said second transistor means to be actuated by said third cyclical signal between conductive and nonconductive states in response to said third cyclical signal wherein said fourth transistor means is actuated to conductive state by a relatively positive portion of each of said third cyclical signal and said sixth transistor means is actuated to conductive state by the relatively negative portion of said third cyclical signal and where the collector of said fourth transistor is connected to said power supply means, the emitter of said fourth transistor is connected to the collector of said sixth transistor and the emitter of said sixth transistor is connected to electrical current sink means and where said speaker means is connected to said collector of said fourth transistor whereby power is supplied to said speaker means when said fourth transistor means is conductive and said sixth transistor means is nonconductive.

* * * * *